137-13 SR
3/1/88 XR 4,728,412

United States Patent [19]
Söderberg

[11] Patent Number: 4,728,412
[45] Date of Patent: Mar. 1, 1988

[54] POUR-POINT DEPRESSION OF CRUDE OILS BY ADDITION OF TAR SAND BITUMEN

[75] Inventor: David J. Söderberg, Naperville, Ill.

[73] Assignee: Amoco Corporation, Chicago, Ill.

[21] Appl. No.: 909,637

[22] Filed: Sep. 19, 1986

[51] Int. Cl.[4] ..... C10G 1/00

[52] U.S. Cl. ..... 208/22; 208/14; 208/39; 208/309; 208/370; 585/13; 137/13; 106/273 R

[58] Field of Search ..... 208/18, 19, 22, 370, 208/14, 39; 585/13; 137/13; 106/273 R

[56] References Cited

U.S. PATENT DOCUMENTS

| | | | |
|---|---|---|---|
| 1,443,983 | 2/1923 | Erdman | 208/18 |
| 1,831,053 | 11/1931 | Wilson | 208/19 |
| 1,889,168 | 11/1932 | Bennet | 208/19 |
| 1,953,039 | 3/1934 | Bonnell | 208/19 |
| 2,073,080 | 3/1937 | Johannes et al. | 208/19 |
| 2,352,213 | 6/1944 | Lieber et al. | 208/19 |
| 2,400,067 | 5/1946 | Best et al. | 208/22 |
| 2,870,080 | 1/1959 | Ilman et al. | 208/19 |
| 3,129,164 | 4/1964 | Cameron | 137/13 |
| 3,308,051 | 3/1967 | Fauber | 208/45 |
| 3,527,692 | 9/1970 | Titus | 137/13 |
| 3,615,799 | 1/1972 | Gannon | 208/22 |
| 3,839,190 | 10/1974 | Frese et al. | 208/22 |
| 3,900,391 | 8/1975 | Merrill, Jr. et al. | 137/13 |
| 3,925,189 | 12/1975 | Wicks, III | 137/13 |
| 3,957,663 | 5/1976 | Shavyrin et al. | 208/19 |
| 4,067,616 | 1/1978 | Smith et al. | 137/13 |
| 4,201,658 | 5/1980 | Jensen | 208/22 |
| 4,213,845 | 7/1980 | Masada | 208/18 |
| 4,365,973 | 12/1982 | Irish | 44/57 |
| 4,368,056 | 1/1983 | Pierce et al. | 44/57 |
| 4,406,773 | 9/1983 | Hettinger, Jr. et al. | 208/52 CT |
| 4,514,283 | 4/1985 | Closmann et al. | 208/370 |

OTHER PUBLICATIONS

Hackh's Chemical Dictionary, 4th Edition, Julius Grant, McGraw-Hill, pp. 64, 101.

*Primary Examiner*—Helen M. S. Sneed
*Assistant Examiner*—Helane Myers
*Attorney, Agent, or Firm*—Ekkehard Schoettle; William H. Magidson; Ralph C. Medhurst

[57] ABSTRACT

The present invention provides a process for reducing the pour point of a crude oil by adding a pour-point depressant selected from the group consisting of raw bitumen and hydrotreated bitumen to form a blend possessing a relatively lower pour point.

12 Claims, 1 Drawing Figure

POUR-POINT DEPRESSION OF CRUDE OILS BY ADDITION OF TAR SAND BITUMEN

BACKGROUND OF THE INVENTION

The process of the present invention relates to an improvement in lowering the pour-point of crude oils, i.e., the temperature at which the crude oil undergoes loss of fluidity, by utilizing a bitumen derived from a tar sand. The loss of fluidity occurs when a relatively small percentage of wax contained in the crude oil precipitates in the form of large interlocking crystals. If the crude is to be pipelined through a location where the ambient temperature is less than the crude's natural pour point, one of two measures must be taken. Either the pipeline must be heated or a "pour-point depressant" must be added to the crude. The cost of these measures can be significant, especially in the case of a heated pipeline.

The term "tar sands" (sometimes also referred to as oil sands or bituminous sands) refers to naturally occurring mixtures of bitumen and sand. Tar sands are typically dark brown to black in color depending upon the bitumen content and composition and can be described either as sand grains cemented by bitumen or as sandstone impregnated with bitumen. Two different types of tar sand bitumen are found to exist in nature. The first of these, as typified by Canadian tar sand deposits, has a layer of connate water surrounding the individual mineral particles. Bitumen is attached outside of this connate water layer. The second type, as typified by U.S. tar sand deposits, does not have this layer of connate water, and the bitumen is attached directly to the mineral particles.

The bitumen of tar sand consists of a mixture of a variety of hydrocarbons and heterocyclic compounds. After the bitumen has been separated from the sand, it can be further treated to form a synthetic crude oil suitable for use as a feedstock for the production of gasoline, heating oil, and/or a variety of petrochemicals. The sand component of tar sand is mostly quartz, with minor amounts of other minerals.

Tar sand deposits often occur in the same geographical area as conventional petroleum deposits; tar sand deposits have been found throughout the world, with the exception of Australia and Antarctica. The major known deposits of tar sands are located in Canada, Venezuela, Utah, Europe, and Africa. It is estimated that the Canadian deposit, known as the "Athabasca tar sands", contains nine hundred (900) billion barrels of oil. About sixty-five percent (65%) of all known oil in the world is contained in tar sand deposits or in heavy oil deposits. The Venezuelan deposit of tar sands is estimated to contain approximately seven hundred (700) billion barrels. The United States has twenty-eight (28) billion barrels in its tar sand deposits. Europe has three (3) billion barrels, and Africa has two (2) billion barrels.

Approximately ninety percent (90%) of the known deposits in the United States are located in Utah, with other major deposits being found in California, Kentucky, and New Mexico. Although the twenty-five (25) billion barrels of bitumen located in Utah may seem small in comparison to the Canadian and Venezuelan deposits, Utah tar sands represent a significant energy resource when compared to crude oil reserves in the United States, which are estimated to be approximately thirty-one (31) billion barrels.

The tar sands located in the Athabasca deposit differ considerably from those deposits located in Utah and other areas of the world. Analysis of the Athabasca tar sands indicate that the average bitumen content is approximately twelve to thirteen percent (12–13%) by weight. The bitumen content of the Utah tar sands, on the other hand, varies from about five percent (5%) to about thirteen percent (13%) by weight, with the average of all deposits being slightly less than ten percent (10%) bitumen by weight.

In any event, due to the remote nature of most tar sand deposits, it is desirable to effect minimal upgrading of the tar sands on-site.

It has now been surprisingly discovered that either raw bitumen or hydrotreated bitumen can be utilized as a crude oil pour-point depressant. This discovery is especially useful where bitumen products need to be transported to a refinery for upgrading, where climatic considerations are important, i.e., ambient temperatures below crude pour point, and where tar sand deposits and crude pipelines are in close proximity. The transport of raw bitumen or hydrotreated bitumen to an existing refinery is desirable since most tar sand occurrences are in remote areas. While it is known that bitumen can be transported in a pipeline with natural gas condensate acting as a diluent, the present invention in contradistinction deals with the addition of bitumen or hydrotreated bitumen to a full boiling range crude oil wherein such addition surprisingly results in the reduction of the pour point of the final blend.

Accordingly, the present invention provides for a method of reducing the pour point of crude oils to be pipelined while concomitantly providing for the transportation of the raw or hydrotreated bitumen to refineries for further upgrading.

SUMMARY OF THE INVENTION

Broadly, the present invention provides a process for reducing the pour point of a crude oil by adding a pour-point depressant selected from the group consisting of raw bitumen and hydrotreated bitumen to form a blend possessing a relatively lower pour point.

In a specific aspect, the present invention provides for the addition of raw bitumen to crude oil in order to reduce the pour point in an amount such that the raw bitumen content ranges from about 1 to about 30 wt. % based on total blend.

In another specific aspect, the present invention provides for the addition of hydrotreated bitumen to crude oil in order to reduce the pour point in an amount such that the hydrotreated bitumen content ranges from about 1 to 60 wt. % based on the total blend weight.

The present invention in another embodiment provides for a blend comprising a crude oil and a pour-point depressant selected from the group consisting of raw bitumen and hydrotreated bitumen. In a specific aspect of this embodiment of the present invention, the blend comprises crude oil and raw bitumen wherein the raw bitumen content ranges from about 1 to about 30 wt. % based on the total blend weight. In another specific aspect of the present embodiment, the blend comprises crude oil and hydrotreated bitumen wherein the hydrotreated bitumen content ranges from about 1 to about 60 wt. % based on the total blend weight.

BRIEF DESCRIPTION OF THE DRAWING

The drawing depicts several plots of pour point versus weight percentage of tar sand product in various crude oil-tar sand product blends.

DETAILED DESCRIPTION OF THE INVENTION

Figure 1:
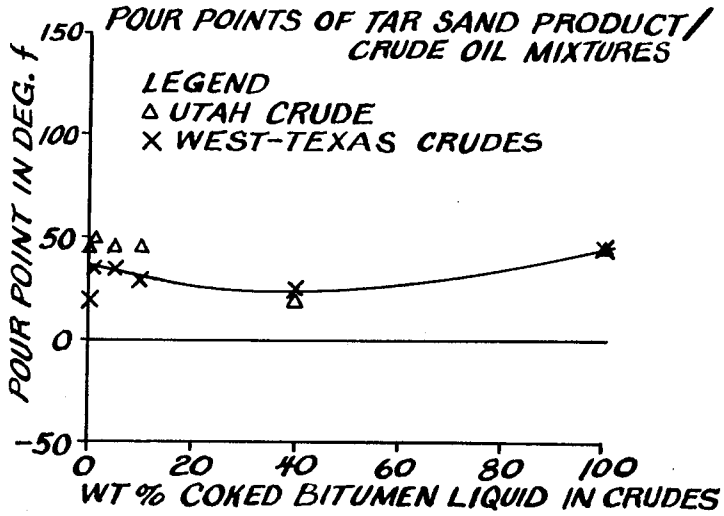
Figure 2:
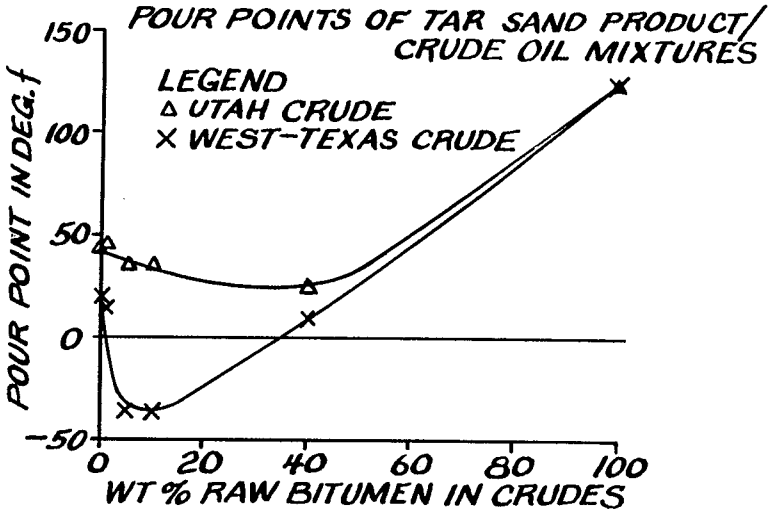
Figure 3:
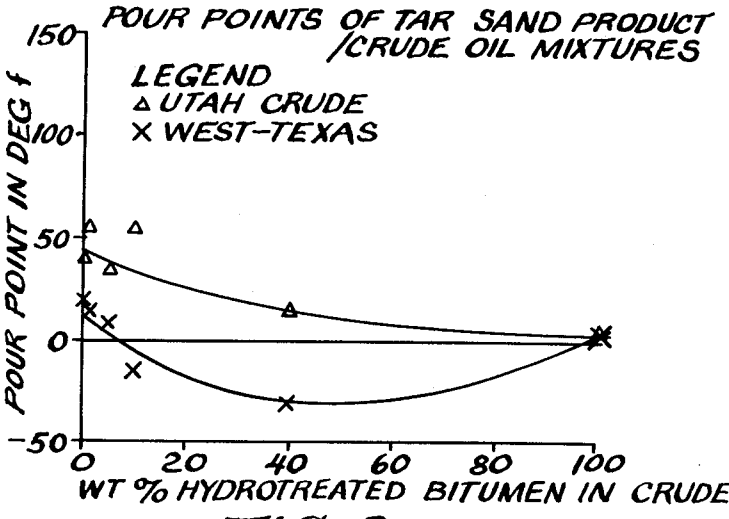
Figure 4:
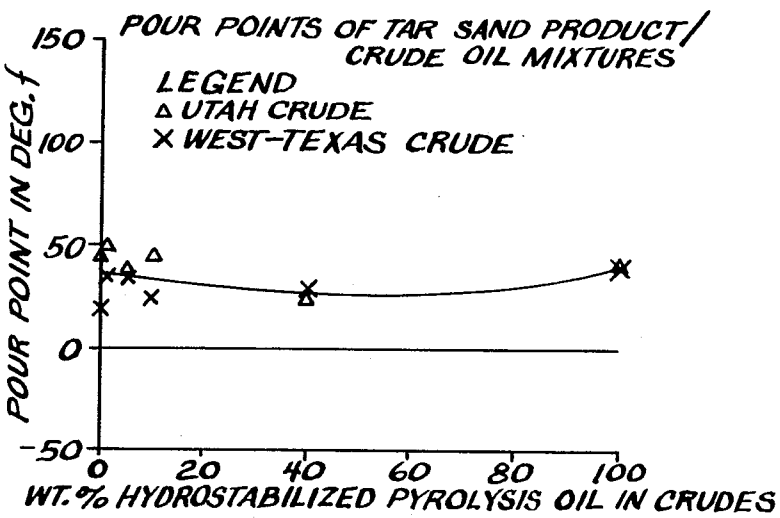

The present invention deals with the addition of raw bitumen or hydrotreated bitumen to a crude oil in order to reduce the pour point of the crude oil.

The study of pour-point behavior in complex hydrocarbon mixtures is still, for the most part, an empirical science. Mixtures containing straight-chain paraffins cease to pour when their temperatures are lowered to such an extent that a relatively small percentage of wax comes out of solution in the form of large interlocking crystals. It is well known that certain substances can act as pour-point depressants by restricting the growth of these wax crystals, such that small independent crystals are formed rather than an interlocking structure of large crystals. These pour-point depressants do not affect the actual amount of wax that separates and therefore do not change the cloud point of the oil. It is believed pour-point depressants function by adsorption onto the growing faces of the wax crystals, thereby forming an imperfection in the crystal face and sterically hindering further growth in that direction.

Adding waxes with different chain lengths to those already present induces mixed-crystal formations (i.e., cocrystallization of different chain length waxes); these are more responsive to pour-point depressants than are "purer" mixtures as described by L. E. Lorensen in "Pour Point Depression: I. Mechanism Studies", ACS Division of Pet. Chem., *Symposium on Polymers in Lubricating Oil,* Atlantic City, Sept. 9–14, 1962, B61–B69 and G. A. Holder and J. Winkler in "Wax Crystallization from Distillate Fuels", Parts I, II, and III, *J. Inst. Pet.,* Vol. 51, No. 499, July 1965, p. 228–252. This probably accounts for the fact that wide boiling-range mixtures may be pour-point depressed to a greater extent than narrow boiling-range fractions as described by J. L. Tiedje in "The Use of Pour Depressants in Middle Distillates", Sixth World Petroleum Congress, Section VI, Paper 1, June 1963. It has also been observed that increased aromaticity of the system can also enhance pour-point depression effects as described in the above paper by J. L. Tiedje.

In any event, it has now been discovered that the addition of either raw bitumen or hydrotreated bitumen to a crude oil results in a blend having a relatively reduced pour point. This discovery also permits the transmission of blends containing a crude oil and raw and/or hydrotreated bitumen in a pipeline with no addition of pour-point depressant or with the addition of reduced amounts of a pour-point depressant.

The raw bitumen suitable for use in the present invention is separated from tar sands by any method known to those skilled in the art. A variety of techniques are generally known for the extraction of bitumen from tar sands. These include hot or cold water separation processes wherein tar sands are contacted with the water under suitable conditions to displace the bitumen from the sand particles followed by a phase separation in a gravity settler wherein raw bitumen floats to the surface and is recovered. Another technique involves solvent extraction wherein the tar sand is contacted with a solvent in an extraction zone with suitable solvents and under suitable conditions to extract the raw bitumen from the tar sand.

The hydrotreated bitumen used in the present invention is prepared by conventional methods known to those skilled in the art. Operating conditions for the hydrotreating zone are set out below:

HYDROTREATING OPERATING CONDITIONS

| Conditions | Broad Range | Preferred Range |
|---|---|---|
| Temperature, °F. | 400–850 | 500–750 |
| Total pressure, psig | 50–4,000 | 400–1,800 |
| LHSV | .10–20 | .25–2.5 |
| Hydrogen rate, SCFB | 500–20,000 | 800–6,000 |
| Hydrogen partial pressure, psig | 50–3,500 | 500–2,000 |

The catalyst employed in the hydrotreater can be any conventional and commercially available hydrotreating catalyst. The subject hydrotreating catalysts typically contain one or more elements from Groups IIB, VIB, and VIII supported on an inorganic refractory support, such as alumina. Catalysts containing NiMo, NiMoP, CoMo, CoMoP, and NiW are most prevalent.

Other suitable hydrotreating catalysts for the hydrotreating stage of the present invention comprise a Group VIB metal component or non-noble metal component of Group VIII and mixtures thereof, such as cobalt, molybdenum, nickel, tungsten and mixtures thereof. Suitable supports include inorganic oxides, such as alumina, amorphous silica-alumina, zirconia, magnesia, boria, titania, chromia, beryllia, and mixtures thereof. The support can also contain up to about 20 wt. % zeolite based on total catalyst weight. A preferred hydrotreating catalyst contains sulfides or oxides of Ni and Mo composited with an alumina support wherein the Ni and Mo are present in amounts ranging from 0.1 wt. % to 10 wt. %, calculated as NiO, and 1 wt. % to 20 wt. %, calculated as $MoO_3$, based on total catalyst weight.

Another preferred hydrotreating catalyst replaces Ni with Co wherein the Co is present in amounts ranging from 0.1 wt. % to 10 wt. % calculated as CoO.

The amount of raw bitumen or hydrotreated bitumen added to the crude oil in accordance with the present invention is an amount sufficient to reduce the pour point of the finally prepared blend. Generally, the amount of raw or hydrotreated bitumen added is an amount sufficient to lower the pour point of the finally prepared blend by at least 10° F. For raw bitumen addition, these amounts range from about 1 to about 30 wt. %, preferably from about 5 to about 15 wt. %, based on the total weight of the blend. For the addition of hydrotreated bitumen, these amounts range from about 1 to about 60 wt. %, preferably from about 10 to about 40 wt. %, based on the total weight of the blend. The upper limit on the amount of raw bitumen or hydrotreated bitumen that can be added to a crude oil may also be limited by viscosity constraints, i.e., the maximum viscosity suitable for pipelining of the final blend.

The present invention can be carried out to prepare blends possessing relatively reduced pour points with any type of crude oil. Best results are achieved with asphaltenic crude oils, whereas the reduction in pour point is not as dramatic when paraffinic crude oils are used.

The pour points of crude oils can be reduced by up to 70° F. in accordance with the present invention. Pour-point depression will, of course, vary depending upon the type of crude oil and bitumen used and the amount of raw or hydrotreated bitumen added.

The addition, mixing, or blending of the raw and/or hydrotreated bitumen is carried out by methods well known to those skilled in the art. This mixing is carried out prior to transmission of the blend in a pipeline.

EXAMPLE

The present invention is further illustrated in the instant example wherein various blends in accordance with the present invention were prepared and their respective pour points determined. Specifically, various tar sand products were mixed in varying proportions with two conventional crudes to prepare several sample blends. Each blend was then tested to determine its pour point using the ASTM D-97 method.

The following Table 1 sets out the properties of four tar sand products used in the present Example sample blends, namely:

(a) coked bitumen liquid,
(b) raw bitumen extract,
(c) hydrotreated bitumen extract, and
(d) hydrostabilized pyrolysis oil.

These tar sand products were prepared from a Sunnyside tar sand. The bitumen was extracted from the Sunnyside tar sand using a solvent mixture of n-pentane/n-hexane. The extracted bitumen was subsequently desalted, distilled to remove solvent, dissolved in toluene, acid (HCl) washed, (this acid treatment effects the removal of the majority of metals present, such as Ni, V and Fe) and finally distilled to remove the toluene. The hydrotreated bitumen was prepared by contacting the raw bitumen in a fixed bed with a hydrotreating catalyst containing 13.82 wt. % $MoO_3$ and 3.47 wt. % CoO. Further hydrotreating catalyst properties included a surface area of 284 $m^2/g$, total pore volume of 0.613 cc/g, and an average pore diameter of 86 angstroms. The hydrotreating conditions included 740° F., 1800 psig, 5000 SCFB hydrogen addition rate, and space velocity of 0.26 reciprocal hours.

TABLE 1

ANALYSES OF TAR SAND PRODUCTS

| | Coked Bitumen Liquid | Raw Bitumen | Hydrotreated Bitumen Extract | Hydrostabilized Pyrolysis Oil |
|---|---|---|---|---|
| API Gravity | 24.7 | 10.1 | 19.7 | 15.8 |
| Pour Point, °F. | 45 | 125 | 0 | 45 |
| Oldershaw Distn | | | | |
| IBP-360° F. | 10.0 | 0.6 | 3.3 | 0.4 |
| 360°-650° F. | 34.5 | 4.6 | 20.9 | 16.8 |
| 650°-1000° F. | 54.5 | 29.4 | 39.4 | 45.2 |
| 1000+° F. | <1%* | 65.4 | 36.4 | 37.6 |
| C, Wt. % | 86.36 | 85.74 | 86.94 | 85.70 |
| H, Wt. % | 12.08 | 11.07 | 12.14 | 11.51 |
| N, Wt. % | 0.298 | 0.70 | 0.368 | 0.715 |
| O, Wt. % | 0.776 | 0.639 | 0.059 | 0.518 |
| S, Wt. % | 0.292 | 0.362 | 0.094 | 0.315 |
| Basic N, Wt. % | — | 0.22 | 0.16 | 0.27 |
| Rams Carbon, Wt. % | — | 12.3 | 6.1 | 3.2 |
| Bromine No cg/g | 28.0 | — | 5.5 | 20.5 |
| Ni, ppm | 6 | 45 | 13 | 25 |
| V, ppm | <2 | 4 | <2 | <2 |
| Fe, ppm | 147 | 35 | 41 | 25 |
| Oils, Wt. % | 79 (El) | 30 | 57 | 56 |
| Resins, Wt. % | 21 (El) | 66 | 38 | 43 |
| Asphaltenes, Wt. % | 0 (El) | 4 | 5 | 1 |
| Ash Oxide, Wt. % | — | 0.02 | 0.0 | 0.0 |
| Karl Fischer Water, Wt % | 2.41 | 0.093 | — | 0.5 |
| Molecular Weight | — | 718 | — | 393 |
| Vis at 40° C. cst | 11.5 | Solid | — | 604 |
| Vis at 100° C. cst | 2.8 | 1500 | 14.9 | 52.5 |

*G.C. simulated distillation data

The following Table 2 sets out the properties of the two crudes used to prepare the subject samples, namely, a light Utah crude having a paraffinic nature and a West Texas "C" crude having an asphaltenic nature.

TABLE 2

ANALYSES OF CRUDES

| | Utah Crude | West Texas "C" Crude |
|---|---|---|
| API Gravity | 33.5 | 31.5 |
| S, Wt. % | 0.56 | 2.14 |
| Pour Point, °F. | 40.0 | 25.0 |
| Vis at 68° F. SSU | 86.0 | 87.0 |
| Vis at 122° F. SSU | 45.2 | 44.3 |
| Dist. Yields, Vol % | | |
| $C_4$ and Lighter | 1.4 | 2.1 |
| Lt. Straight Run | 6.7 | 11.7 |
| Reformer Feed | 12.6 | 16.8 |
| Heater Oil (550° F. EP) | 18.2 | 16.8 |
| Furnace Oil (650° F. EP) | 8.2 | 6.7 |
| Lt. FCU Feed | 8.7 | 6.7 |
| Hvy. FCU Feed | 27.2 | 22.8 |
| Reduced Crude (1010+° F.) | 17.3 | 16.7 |
| Virgin Cuts | | |
| Lt. Straight Run API | 78.9 | 71.0 |
| S, Wt. % | 0.01 | 0.27 |
| MON | 68.0 | 71.9 |
| Reformer Feed API | 55.6 | 50.1 |
| S, Wt. % | 0.01 | 0.27 |
| Arom + Naph, Vol. % | 44.7 | 54.1 |
| Heater Oil API | 40.1 | 38.2 |
| S, Wt. % | 0.20 | 0.96 |
| Blend Pour, °F. | −27 | −26 |
| Cetane Index | 44.5 | 40.0 |
| Furnace Oil API | 33.6 | 30.0 |
| S, Wt. % | 0.52 | 1.87 |
| Blend Pour, °F. | 56 | 59 |
| Cetane Index | 50.7 | 45.0 |
| Lt. FCU Feed API | 28.7 | 24.2 |
| S, Wt. % | 0.71 | 2.45 |
| $C_A$, Wt. % | 12.2 | 15.3 |
| N, Wt. % | 0.040 | 0.062 |
| Hvy. FCU Feed API | 27.1 | 21.7 |
| S, Wt. % | 0.72 | 2.63 |

TABLE 2-continued

| ANALYSES OF CRUDES | Utah Crude | West Texas "C" Crude |
|---|---|---|
| $C_A$, Wt. % | 12.1 | 15.2 |
| N, Wt. % | 0.069 | 0.098 |
| Ni Eqiv, ppm | 0.4 | 0.7 |
| Reduced Crude API | 12.5 | 4.6 |
| S, Wt. % | 1.10 | 4.56 |
| Rams, Wt. % | 12.5 | 19.9 |
| V, ppm | 6.0 | 61.0 |

FIG. 1 graphically depicts the results of the tests carried out on the prepared samples. The figure contains plots 1 through 4 which show the effect upon pour point of the addition of various amounts of coked bitumen liquid, raw bitumen, hydrotreated bitumen, and hydrostabilized pyrolysis oil, respectively, to a Utah crude and a West Texas crude.

An inspection of plots 1 and 4 shows that mixtures of coked bitumen liquid and hydrostabilized pyrolysis oil in the crudes showed essentially no change from the pure components in their pour-point behavior. Pour points of these mixtures remain in the range of about 20° to about 50° F. which is probably too high to be pipelined successfully during the winter.

Plots 2 and 3 show that mixtures of raw and hydrotreated bitumens in the crudes in accordance with the present invention exhibit depressed pour points relative to the pour points of the respective pure components. This effect is most marked for mixtures of West Texas crude, especially for the case of low concentrations of raw bitumen in this crude. The effect of raw bitumen upon pour-point depression is particularly surprising since the raw bitumen possesses a pour point of 125° F.

What is claimed is:

1. A process for reducing the pour point of a crude oil which comprises adding a pour-point depressant selected from the group consisting of a raw tar sands bitumen and hydrotreated tar sands bitumen to form a blend possessing a relatively lower pour point.

2. The process of claim 1 wherein said raw bitumen is added to said crude oil in an amount such that said raw bitumen ranges from about 1 to about 30 wt. % based on the total weight of said blend.

3. The process of claim 1 wherein said hydrotreated bitumen is added to said crude oil in an amount such that said hydrotreated bitumen ranges from about 1 to about 60 wt. % based on the total weight of said blend.

4. The process of claim 1 wherein said raw bitumen is added to said crude oil in an amount such that said raw bitumen ranges from about 5 to about 15 wt. % based on the total weight of said blend.

5. The process of claim 1 wherein said hydrotreated bitumen is added to said crude oil in an amount such that said hydrotreated bitumen ranges from about 10 to about 40 wt. % based on the total weight of said blend.

6. The process of claim 1 wherein said crude oil is asphaltenic in nature.

7. A blend comprising a crude oil and a sufficient amount of a pour-point depressant selected from the group consisting of raw tar sands bitumen and hydrotreated tar sands bitumen to depress the pour point of said blend.

8. The blend of claim 7 wherein said raw bitumen is present in an amount ranging from about 1 to about 30 wt. % based on the total weight of said blend.

9. The blend of claim 7 wherein said raw bitumen is present in an amount ranging from about 5 to about 15 wt. % based on the total weight of said blend.

10. The blend of claim 7 wherein said hydrotreated bitumen is present in an amount ranging from about 1 to about 60 wt. % based on the total weight of said blend.

11. The blend of claim 7 wherein said hydrotreated bitumen is present in an amount ranging from about 10 to about 40 wt. % based on the total weight of said blend.

12. The blend of claim 7 wherein said crude oil is asphaltenic in nature.

* * * * *